169-46 SR
1/12/88 XR 4,718,497

United States Patent [19]
Moore et al.

[11] Patent Number: 4,718,497
[45] Date of Patent: Jan. 12, 1988

[54] FIRE AND EXPLOSION DETECTION AND SUPPRESSION

[75] Inventors: Peter E. Moore, Reading; Brian D. Powell, Maidenhead, both of England

[73] Assignee: Graviner Limited, Berkshire, England

[21] Appl. No.: 934,664

[22] Filed: Nov. 25, 1986

[30] Foreign Application Priority Data

Dec. 20, 1985 [GB] United Kingdom ..... 8531487

[51] Int. Cl.[4] ..... A62C 37/04
[52] U.S. Cl. ..... 169/61; 340/578; 169/46
[58] Field of Search ..... 340/578, 522; 244/114 R, 129.2; 169/60, 61, 23, 46, 47

[56] References Cited

U.S. PATENT DOCUMENTS 3,609,364 9/1971 Paine et al. ..... 340/578 X
3,716,717 2/1973 Scheidweiler et al. ..... 340/578 X
4,414,542 11/1983 Farquhar et al. ..... 340/578
4,423,326 12/1983 Ball ..... 340/578 X
4,553,031 11/1985 Cholin et al. ..... 340/578 X

*Primary Examiner*—Jeffrey V. Nase
*Assistant Examiner*—James M. Kannofsky
*Attorney, Agent, or Firm*—Leydig, Voit & Mayer

[57] ABSTRACT

A fire and explosion detection and suppression system protects two physically adjacent zones in each of which there is a UV sensor and an IR sensor. In each zone, simultaneous detection, by the pair of sensors, of sufficient respective levels of UV and IR causes an AND gate to set off suppressor units to discharge suppressant into the zone being protected. Some of this suppressant may drift into the adjacent zone and may attenuate UV radiation in that zone. Thus, for at least a temporary period, that zone may be incapable of detecting a subsequently occurring fire or explosion. Therefore, by means of a latching circuit the output signal of an operating one of the AND gates temporarily renders the circuit of the adjacent zone capable of operating independently of UV radiation.

12 Claims, 4 Drawing Figures

FIRE AND EXPLOSION DETECTION AND SUPPRESSION

BACKGROUND OF THE INVENTION

The invention relates to fire and explosion detection and suppression. More specifically, the invention relates to such systems employing sensors of electromagnetic radiation.

SUMMARY OF THE INVENTION

According to the invention, there is provided a fire and explosion detection and suppression system, comprising a plurality of radiation sensors each producing an electrical signal in response to detection of at least a predetermined amount of a respective predetermined type of electromagnetic radiation, alarm means having a normal mode of operation and a modified mode of operation and connected to receive the said electrical signals, the alarm means being operative in the said normal mode to produce a first alarm signal only in response to the receipt of said electrical signals from a predetermined number of the sensors including at least one sensor responsive to a first said predetermined type of radiation and being operative in the said modified mode to produce a second alarm signal in response to the receipt of one or more said electrical signals from a different predetermined number of sensors and not including the said sensor responsive to the said first predetermined type of radiation, and switching means operative to switch the alarm means from the normal to the modified mode in response to discharge into the vicinity of the said sensor responsive to the said first predetermined type of radiation of a fluid agent which attenuates radiation of the said first predetermined type.

According to the invention, there is also provided a fire and explosion detection and suppression system, comprising, for each of a plurality of physical zones, a respective plurality of radiation sensors each producing a respective electrical signal in response to detection of at least a predetermined amount of radiation of respective type, suppression means for each zone and normally operative only in response to the simultaneous production by at least two sensors in that zone of their said electrical signals whereby to discharge a suppressant agent into that zone for extinguishing fires or suppressing explosions therein, the suppressant agent having the characteristic that it attenuates radiation of the type to which one of said two sensors in each zone responds but does not significantly attenuate radiation of the type to which the other of the said two sensors responds, and modifying means operative in response to such discharge to temporarily modify the suppression means of an adjacent said zone whereby to render it capable of operating in response to the production of its said electrical signal by only the said other of the two sensors in that adjacent zone.

Accordingly to the invention, there is further provided a fire detection and suppression system for detecting and suppressing fires or explosions within an area divided into at least two adjacent zones, comprising, for each said zone: a plurality of ultra-violet radiation responsive sensors each producing a first electrical signal in response to receipt of at least a predetermined amount of ultra-violet radiation, a plurality of infra-red radiation-responsive sensors each producing a second electrical signal in response to at least a predetermined amount of infra-red radiation, processing means connected to receive said first and second electrical signals and switchable between a normal mode in which it produces an alarm output only when it simultaneously receives a predetermined plurality of said electrical signals which includes at least one said first electrical signal and a modified mode in which it produces an alarm output in response to receipt of a different plurality of said electrical signals which does not include any said first electrical signals, suppressant discharge means responsive to each said alarm signal to cause discharge of an ultra-violet attenuating fire or explosion suppressant into the said zone, and switching means responsive to production of the said alarm signal when the processing means of that zone is in the normal mode to temporarily switch the processing means of the other zone into the modified mode.

According to the invention, there is yet further provided a method of zone by zone protection against fires or explosions of a predetermined area, comprising the steps of detecting, within each of two adjacent zones, for the simultaneous presence of at least predetermined respective amounts of two predetermined and different types of electromagnetic radiation, responding thereto by releasing a predetermined fire or explosion suppressant into the zone in respect of which such detection takes place, the said suppressant being of a type which attenuates radiation of one said type, and for a predetermined time thereafter detecting, in the adjacent said zone, for the presence of the said respective amount of radiation of the other said type and releasing the said suppressant into that adjacent zone in response to such detection.

DESCRIPTION OF THE DRAWINGS

Fire and explosion detection and suppression systems and methods according to the invention will now be described, by way of example only, with reference to the accompanying diagrammatic drawings in which.

DESCRIPTION OF PREFERRED EMBODIMENTS

Figure 1:
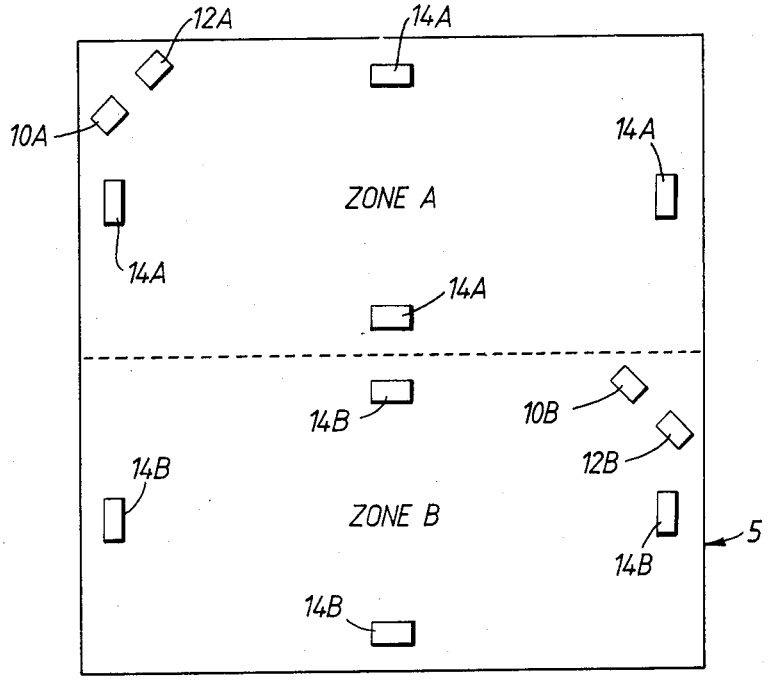
FIG. 1 is a diagrammatic view of an area to be protected by the system, showing sensors of the system installed.

As shown in FIG. 1, an area 5 is to be protected from fires or explosions. The area 5 may, for example, be an enclosed building. As shown in FIG. 1, the area is divided into two zones, Zone A and Zone B. Two electromagnetic radiation sensors, 10A and 12A, are suitably mounted within Zone A so as to be able to monitor substnatially the whole of the Zone and detect radiation arising in it. Two similar sensors, 10B and 12B are correspondingly mounted within Zone B. The sensors 10A,10B,12A,12B are of a type which produces an electrical signal related to the electromagnetic radiation received.

The sensors 10A and 10B are sensors of ultra-violet radiation. They may be of any suitable type but are preferably of the gas discharge or solid state avalance detector type, such as cold cathode gas discharge tube. They are arranged to be responsive to ultra-violet radiation of the wavelength or wavelengths likely to be emitted by fires or explosions of the type to be detected and suppressed.

The sensors 12A and 12B are arranged to be sensitive to infra-red radiation within a wavelength range likely to be emitted by fires or explosions to be detected and suppressed. The sensors 12B can be of any suitable type. They may, for example, be of the photo-diode type or they may be thermopiles.

In each case, the sensors may be arranged to view the respective zones through radiation filters having appropriate wavelength bands.

Within each zone are mounted one or more suppression units 14A and 14B. Four such units are shown in each zone, but there may of course be more or less than this. They are positioned so as to be able to discharge suppressant over substantially the whole of the corresponding zone, the suppressant being of a suitable type to extinguish the fires and explosions detected. In a manner to be explained, the suppression units are activated, to discharge their suppressant, in response to operation of the sensors, that is, in response to the sensors receiving radiation indicating the presence of a fire or explosion to be suppressed.

Figure 2:
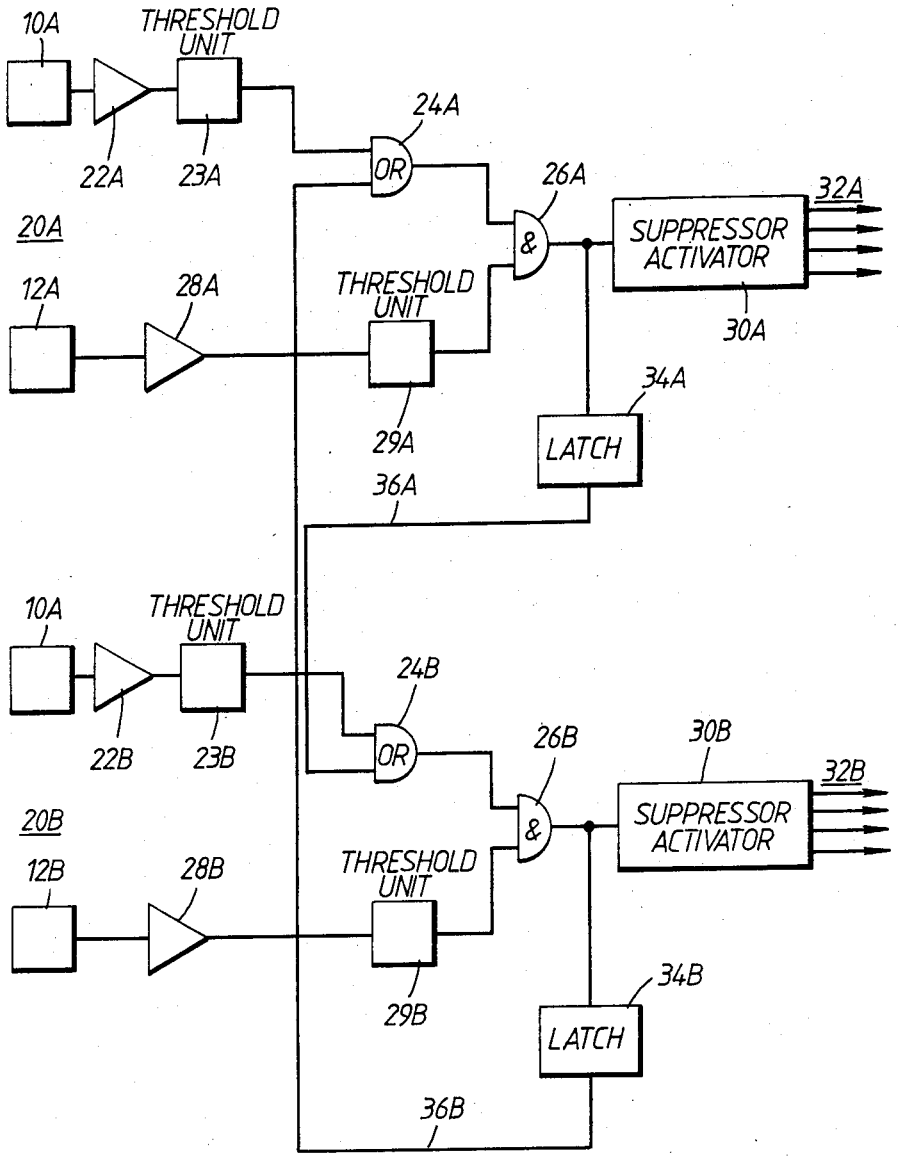
FIG. 2 is a block circuit diagram of the system.

FIG. 2 shows a block diagram of the system. As shown, it comprises two sections, a section 20A corresponding to Zone A and a section 20B corresponding to Zone B.

As shown, in Section 20A, the electrical output of sensor 10A is fed to an amplifying and processing unit 22A. This basically amplifies the signal from sensor 10A but may also process it in a suitable way. If the sensor 10A is of the cold cathode gas discharge tube type, its operation will involve it "avalanching" in response to incidence of ultra-violet radiation above a certain level, resulting in the emission of an electrical pulse. In such a case, the circuit unit 22A can be arranged to produce an output signal in response to occurrence of a certain number of such pulses within a certain time interval, so as to reduce false warning such as may be caused by ultra-violet radiation from other sources (e.g. solar radiation). The electrical signal from the circuit unit 22A, which will be dependent on the level of radiation received by the sensor, is fed to a threshold unit 23A which produces an output (of fixed level) only if the incoming signal has such magnitude as indicates that the received radiation is above a predetermined level. The output of the unit 23A is fed to one input of an OR gate 24A whose output feeds one input of an AND gate 26A.

The electrical output of the infra-red sensor 12A is fed to a suitable amplifying and processing circuit unit 28A. The output, which will be dependent on the level of radiation received by the sensor and/or its time dependent variation, is fed to a threshold unit 29A which produces an output (of fixed level) only if the incoming signal has such magnitude as indicates that the received radiation is above a predetermined level. The output of unit 29A is fed to the second input of the AND gate 26A.

The output of the AND gate 26A is fed to a suppressor actuating unit 30A. When operated by a signal from the output of the AND gate, the unit 30A produces four output signals on output lines 32A which are respectively fed to the four suppressor units 14A (FIG. 1) and cause them to discharge their suppressant into Zone A.

It will therefore be apparent that simultaneous occurrence of ultra-violet and infra-red radiation at a level above respective thresholds set by the threshold units 23A and 29A will cause AND gate 26A to produce an output signal which will result in the suppressor units 14A discharging suppressant into Zone A. Such receipt of radiation is assumed to indicate presence of a fire or explosion to be suppressed.

Section 20B is similar in construction and operation, and will not be separately described; parts in Section 20B corresponding to those in Section 20A are similarly referenced except for the use of the suffix "B" instead of "A". Therefore, detection by sensors 10B and 12B of ultra-violet and infra-red radiation above thresholds respectively set by the threshold units 23B and 29B will result in AND gate 26B causing the suppressor units 14B to discharge suppressant into Zone B.

The radiation wavelengths to which the sensors are responsive are selected so as to minimise false alarms due to extraneous sources of radiation: e.g. solar radiation, lighting within the building, hot surfaces, and the like. Thus, such extraneous sources of radiation are unlikely to actuate both of each pair of detectors simultaneously.

Various types of suppressant may be used. One suitable form of suppressant is Halon. However, one of the characteristics of Halon is that it considerably attenuates ultra-violet radiation.

Therefore, in the system as so far described, there is a risk that operation of the suppressor units in one zone, Zone A, say, as a result of simultaneous detection of the appropriate levels of ultra-violet and infra-red radiation by the sensors 10A and 12A in the manner described, will impair, at least temporarily, the readiness of the ultra-violet sensor in the other zone. Thus, discharge of Halon into Zone A may result in some of the Halon entering Zone B and obscuring the area of view of the ultra-violet radiation sensor 10B. Therefore, if a fire or explosion should occur within Zone B, sensor 10B may not detect the resultant ultra-violet radiation because of the attenuating effect of this drifting Halon. Even though the infra-red radiation sensor 12B may detect infra-red radiation above the required threshold, this will not of course be sufficient to enable the AND gate 26B to operate the suppressors units. The same problem could obviously arise in the event of discharge of suppressant by the suppressor units 14B (in response to operation of the detectors 10B and 12B); that is, Halon drifting into Zone A could impair its subsequent operation by attenuating ultra-violet radiation reaching detector 10A.

In order to deal with this problem, the two Sections 20A and 20B of the circuit diagram (FIG. 2) are interlinked. Thus, the output of the AND gate 26A is fed to a latching circuit 34A, such as a monostable multi-vibrator. The output of the latching circuit 34A is fed on a line 36A to the second input of the OR gate 24B in the Section 20B. Correspondingly, the output of the AND gate 26B is fed to a similar latching circuit 34B whose output on line 36B feeds the second input of the OR gate 24A in Section 20A.

Therefore, in the event of sensors 10A and 12A detecting sufficient levels of radiation, so as to cause AND gate 26A to actuate the suppressors 14A (FIG. 1) via the suppressor actuator 30A, the latch 34A will also be set and will produce an output signal on its line 36A for a predetermined length of time. This output signal will thus enable the AND gate 26B through the OR gate 24B. Therefore, for the length of the predetermined latching time of the latch 34A, the circuit arrangement of Section 20B only requires detection of sufficient infra-red radiation by sensor 12B in order to actuate the suppressor units 14B. In other words, AND gate 26B will produce an output merely in response to detection of a sufficient level of infra-red radiation by the sensor 12B.

The predetermined length of time of latch 34A is arranged to be at least sufficient to enable the ultra-violet radiation-attenuating effect of any Halon drifting into Zone B from Zone A to have dissipated.

It will be apparent that latch 34B has a corresponding effect on the circuit section 20A in the event of the sensors 10A and 12B simultaneously detecting sufficient respective levels of ultra-violet and infra-red radiation. Thus, this will cause actuation of the suppressor units 14B and at the same time switch the Section 20A so that, for the duration of the predetermined latching time of latch 34B, Section 20A only requires detection of sufficient infra-red radiation by sensor 12B to cause suppressor units 14A to be operated.

Effectively, therefore, the latch 34A or 34B of one zone respectively operates to render the operation of the circuitry in the other zone temporarily independent of ultra-violet radiation.

Although the problem discussed above has been discussed in relation to the attenuation effect of Halon, other suppressants may have a correspondingly attenuating effect on ultra-violet radiation and the circuitry described can similarly be used to overcome this.

It will also be appreciated that the circuitry may easily be modified to take account of suppressant agents which might have an attenuating effect on infra-red radiation.

Modified forms of the system described may involve the use of two sensors in each zone but both of which are responsive to the same basic type of radiation: for example, both sensors in each zone could be responsive a to infra-red radiation but in respectively different infra-red radiation bandwidths. If the suppressant agent used were such that it significantly attenuated infra-red radiation in one bandwidth, but not in the other, then it will be appreciated that a circuit of the general form shown in FIG. 2 could likewise be used.

In the system described, it has been assumed that there are merely two zones. However, there could of course be more than two zones. In such a case, simultaneous detection of suitable levels of appropriate radiation by the two sensors in one zone would be arranged (besides operating the suppressor units of that zone) to modify the operation of the circuit in not merely one adjacent zone but in two (or more) adjacent zones into both or all of which the suppressant might drift. Thus, in both or all of such adjacent zones, it would render the circuitry operative to set off the suppressor units in that zone merely in response to detection of an appropriate level of radiation by only one of the sensors (the one not adversely affected by the drifting suppressant).

Figure 3:
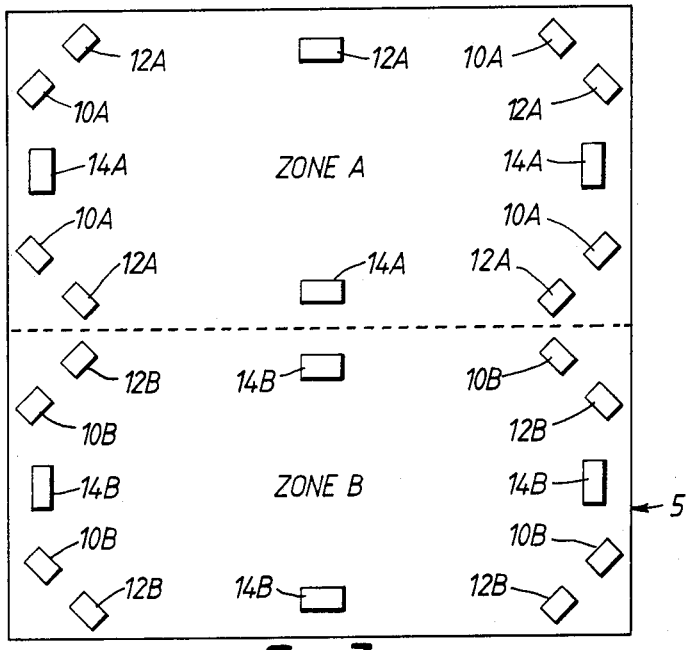
FIG. 3 is a view corresponding to FIG. 1 but showing a modified form of the system.
Figure 4:
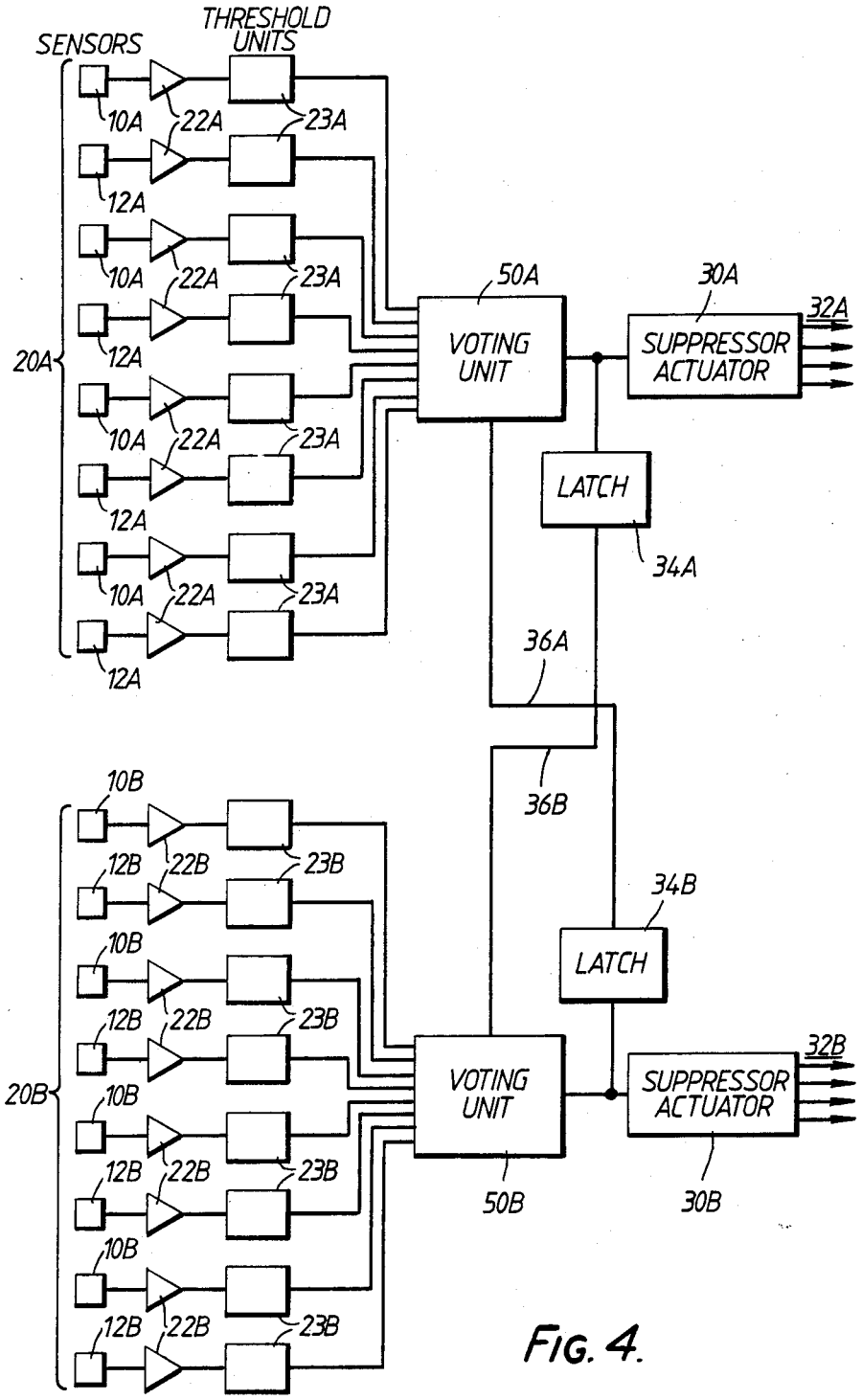
FIG. 4 is a block circuit diagram of the modified system.

FIGS. 3 and 4 illustrate a modifed form of the system and items in these Figures corresponding to items in FIGS. 1 and 2 have the same reference.

As shown in FIG. 3, each zone has four pairs of sensors 10A,12A (or 10B,12B in the case of Zone B), each pair of sensors forming a single detector. Such an arrangement provides better total coverage of the area being protected.

As shown in FIG. 4, within each circuit section (Section 20A or 20B) each sensor is connected via a processing unit 22A and a threshold unit 23A (for Section 20A) or via a processing unit 22B and a threshold unit 23B (for Section 20B) to a respective voting unit 50A or 50B. Each voting unit produces a respective output only when it receives a predetermined pattern of inputs (that is, a predetermined number of inputs from UV sensors and a predetermined number of inputs from IR sensors). The output of each voting unit is fed to the respective suppressor actuator unit 30A,30B. It is thus not necessary for all the sensors within a zone to have detected the necessary amount of the appropriate radiation in order to set off the suppressor units. As long as at least a predetermined number of UV sensors and at least a predetermined number of IR sensors have detected the necessary amount of radiation, the voting unit will fire the suppressor units.

When the voting unit 50A produces its output, to the suppressor actuator 30S, this is also fed via latch 34A and line 36A to the voting unit 50B. There it reconfigures the voting regime of the unit so that for the duration of the latch output the voting unit 50B can produce its output (to fire the suppressor units 14B) in response to a different pattern of input signals and one which does not require inputs from any UV sensor 10B in Zone B. Thus the attenuating effect on the operation of the sensors 10B caused by any Halon which may have drifted into Zone B from the suppressors 14A is overcome. Similarly, of course, production of an output from voting unit 50B, in response to receipt of its normal pattern of votes, reconfigures the voting regime of the voting unit 50A (via latch 34B and line 36B).

What is claimed is:

1. A fire and explosion detection and suppression system, comprising a plurality of radiation sensors each producing an electrical signal in response to detection of at least a predetermined amount of a respective predetermined type of electromagnetic radiation, alarm means having a normal mode of operation and a modified mode of operation and connected to receive the said electrical signals, the alarm means being operative in the said normal mode to produce a first alarm signal only in response to the receipt of said electrical signals from a predetermined selection of the sensors including at least one sensor responsive to a first said predetermined type of radiation and being operative in the said modified mode to produce a second alarm signal in response to the receipt of said electrical signals from a different predetermined selection of the sensors not including the said sensor responsive to the said first predetermined type of radiation, and switching means operative to switch the alarm means from the normal to the modified mode in response to discharge into the vicinity of the said sensor responsive to the said first predetermined type of radiation of a fluid agent which attenuates radiation of the said first predetermined type.

2. A system according to claim 1, in which the said fluid agent is a fire or explosion suppressant agent.

3. A system according to claim 1, in which the said plurality of sensors are for positioning in a first physical zone and including first suppressant discharge means responsive to the said alarm signal produced by the said alarm means for discharging a suppressant agent into that zone, and a second similar plurality of said sensors for positioning in an adjacent physical zone, similar said alarm means connected to receive the electrical signals from the sensors of the adjacent zone, and similar said switching means for the alarm means of the adjacent zone, and second suppressant discharge means for discharging a suppressant agent into the adjacent zone in response to a said alarm signal from the alarm means of that zone, each said switching means being operative in response to production of a said first alarm signal by the alarm means of the other zone, the said fluid agent being the suppressant agent.

4. A system according to claim 1, in which the said first predetermined type of radiation is ultra-violet radiation.

5. A system according to claim 4, in which an or the other said predetermined type of radiation is infra-red radiation.

6. A system according to claim 1, in which the said agent is Halon.

7. A fire and explosion detection and suppression system, comprising, for each of a plurality of physical zones, a respective plurality of radiation sensors each producing a respective electrical signal in response to detection of at least a predetermined amount of radiation of a respective type, suppression means for each zone and normally operative only in response to the simultaneous production by at least two sensors in that zone of their said electrical signals whereby to discharge a suppressant agent into that zone for extinguishing fires or suppressing explosions therein, the suppressant agent having the characteristic that it attenuates radiation of the type to which one of the said two sensors in each zone responds but does not significantly attenuate radiation of the type to which the other of the said two sensors responds, and modifying means operative in response to such discharge to temporarily modify the suppression means of an adjacent said zone whereby to render it capable of operating in response to the production of its said electrical signal by only the said other of the said two sensors in that adjacent zone.

8. A fire detection and suppression system for detecting and suppressing fires or explosions within an area divided into at least two adjacent zones, comprising, for each said zone:

a plurality of ultra-violet radiation-responsive sensors each producing a first electrical signal in response to receipt of at least a predetermined amount of ultra-violet radiation, a plurality of infra-red radiation-responsive sensors each producing a second electrical signal in response to at least a predetermined amount of infra-red radiation, processing means connected to receive said first and second electrical signals and switchable between a normal mode in which it produces an alarm output only when it simultaneously receives a predetermined plurality of said electrical signals which includes at least one said first electrical signal and a modified mode in which it produces an alarm output in response to receipt of a different plurality of said electrical signals which does not include any said first electrical signals, suppressant discharge means responsive to each said alarm signal to cause discharge of an ultra-violet attenuating fire or explosion suppressant into the said zone, and switching means responsive to production of the said alarm signal when the processing means of that zone is in the normal mode to temporarily switch the processing means of the other zone into the modified mode.

9. A method of zone by zone protection against fires or explosions of a predetermined area, comprising the steps of detecting, within each of two adjacent zones, for the simultaneous presence of at least predetermined respective amounts of two predetermined and different types of electromagnetic radiation, responding thereto by releasing a predetermined fire or explosion suppressant into the zone in respect of which such detection takes place, the said suppressant being of a type which attenuates radiation of the one said type, and for a predetermined time thereafter detecting, in the adjacent said zone, for the presence of the said respective amount of radiation of the other said type and releasing the said suppressant into that adjacent zone in response to such detection.

10. A method according to claim 9, in which the said one type of radiation is ultra-violet radiation.

11. A method according to claim 10, in which the said other type of radiation is infra-red radiation.

12. A method according to claim 11, in which the said suppressant is Halon.

* * * * *